United States Patent [19]

Rasmussen

[11] 3,953,202

[45] Apr. 27, 1976

[54] PHOSPHORUS-BEARING MASTER COMPOSITION FOR ADDITION TO HYPER-EUTECTIC SILICON-ALUMINUM CASTING ALLOYS AND PROCESS THEREFOR

[75] Inventor: Robert T. C. Rasmussen, Pottstown, Pa.

[73] Assignee: Kawecki Berylco Industries, Inc., Reading, Pa.

[22] Filed: Feb. 10, 1975

[21] Appl. No.: 548,278

[52] U.S. Cl. ..... 75/148; 75/68 R; 75/122; 75/124; 75/134 F; 75/138

[51] Int. Cl.[2] ..... C22C 21/00

[58] Field of Search ..... 75/148, 138, .5 R, 68 R, 75/124, 122, 134 F; 29/192

[56] References Cited

UNITED STATES PATENTS 1,940,922 12/1933 Sterner-Rainer ..... 75/148

*Primary Examiner*—R. Dean

*Attorney, Agent, or Firm*—Pennie & Edmonds

[57] ABSTRACT

A master composition for refining the primary silicon grains of hyper-eutectic silicon-aluminum casting alloys comprises an intimate admixture, in compact form, of pulverized ferrophosphorus and aluminum metal powder.

11 Claims, No Drawings

PHOSPHORUS-BEARING MASTER COMPOSITION FOR ADDITION TO HYPER-EUTECTIC SILICON-ALUMINUM CASTING ALLOYS AND PROCESS THEREFOR

BACKGROUND OF THE INVENTION

This invention relates to master compositions for refining the primary silicon grains of hyper-eutectic silicon-aluminum casting alloys.

Hyper-eutectic silicon-aluminum alloys (i.e., alloys containing more than 12.5 percent silicon), to be suitable for casting, require refinement of the primary silicon grains. Heretofore, phosphorus, in the form of 7 to 15 percent phos-copper has been the conventional agent for achieving this purpose. However, phos-copper has the disadvantage of high cost, particularly when added to hyper-eutectic silicon-aluminum which has been prealloyed with the commonly required percentage of copper so that no credit can be taken for the copper added with the phos-copper grain refiner. Another disadvantage inherent in the use of phos-copper is the fact that the copper specification for the hyper-eutectic silicon-aluminum alloy might be exceeded upon one or more remeltings which require further grain refining by the addition of phos-copper after each remelting.

Phosphorus-silicon master compositions containing 1 to 10 percent phosphorus, formed by adding ferrophosphorus to molten silicon, have also been used as grain-refiners for hyper-eutectic silicon-aluminum casting alloys. Master compositions of this type have good "holding power", i.e., continued refinement of the primary silicon grains of the casting alloy even after remelting. However, phosphorus-silicon master compositions have not been found to be commercially useful, mainly because they give off highly toxic phosphine when exposed to moisture in the ambient atmosphere.

A need has therefore existed in the hyper-eutectic silicon-aluminum casting alloy field for a grain-refiner which is free of the foregoing disadvantages.

Accordingly, it is an object of the present invention to provide an improved phosphorus-containing master composition for refining the primary silicon grain structure of hyper-eutectic silicon-aluminum casting alloys which does not require the use of copper as a constitutent of said master composition.

Another object is to provide an improved phosphorus-containing master composition for refining the grain structure of hyper-eutectic silicon-aluminum casting alloys which is not subject to the formulation of phosphine when the master composition is exposed to moisture in the ambient atmosphere.

Yet another object of the invention is to provide a process for refining the primary silicon grain structure of hyper-eutectic silicon-aluminum casting alloys by the addition to said alloys of a phosphorus-bearing master composition without the co-addition of copper and which is not attended by the evolution of phosphine.

These and other objects of the invention as well as a fuller understanding of the advantages thereof can be had by reference to the following description and claims.

DESCRIPTION OF THE INVENTION

The foregoing objects are achieved according to the present invention wherein a phosphorus-bearing master composition as equally effective as the known phos-copper master alloy on a per-unit phosphorus basis is obtained by forming an intimate mixture of particles of ferrophosphorus and particles of aluminum metal. The master composition is added, in compacted form, to a molten hyper-eutectic silicon-aluminum casting alloy in an amount which is at least sufficient to refine the primary silicon grain structure of the alloy. The actual amount is determined in each case by the make-up of the particular Si/Al alloy to be treated and by the degree of grain refinement desired. Generally, the master composition is added to the molten silicon-aluminum alloy in an amount which introduces at least about 0.01 weight percent and preferably about 0.025 weight percent phosphorus into the alloy.

The master composition of the invention is produced by intimately admixing particulate ferrophosphorus with aluminum metal powder. Subsequent compaction of the master composition at the conventional aluminum powder compression pressures is used to form appropriately shaped compacts for addition to molten hyper-eutectic silicon-aluminum casting alloys to facilitate incorporation of the master composition into the molten alloy. Both components of the master composition should be initially finely divided, desirably to about minus 100 mesh Tyler Standard, with about minus 325 mesh being preferred for optimum results.

The ferrophosphorus suitable for use in the present invention desirably contains between about 20 and 30 weight percent phosphorus, with the balance being made up of essentially iron. Preferably, the ferrophosphorus contains between about 23 and 28 percent phosphorus, with about 25 weight percent being especially preferred.

In formulating the master composition, the ferrophosphorus is used in crushed form or otherwise comminuted. The aluminum component is used in powder form and is desirably of commercially high grade purity. The ferrophosphorus and aluminum components are combined in weight ratios of desirably between about 3:2 and 2:3, with a weight ratio of about 1:1 being preferred. In combining the ferrophosphorus and aluminum components, the materials are blended and prior to use the master composition is compressed or compacted at suitable pressures, with or without the use of a binder, preferably in the form of briquettes or other convenient shapes of appropriate size.

In addition to the above-described ferrophosphorus and aluminum components, the master compositions of the present invention can contain silicon fines of desirably minus 325 mesh in amounts so as to compensate for the dilution of the silicon content of the casting alloy being refined caused by the addition of the master composition.

DESCRIPTION OF PREFERRED EMBODIMENTS

The following examples are provided for the purpose of illustrating (without limiting) the phosphorus-bearing master composition and process of the invention. Parts and percentages are by weight unless otherwise indicated.

EXAMPLE 1

Minus 325 mesh pulverized commercial grade ferrophosphorus (about 25 weight percent phosphorus and the balance essentially iron) was throughly blended with minus 325 mesh commercially pure aluminum powder in the proportions of about equal parts by weight to yield a master composition analyzing about 12.5 percent phosphorus, 37.5 percent iron and the balance essentially aluminum. The composition is then combined with silicon fines (minus 325 mesh) in order to prevent dilution of the silicon content of the hyper-eutectic Si/Al alloy by the addition of the master composition. The amount of silicon fines added to the ferrophosphorus-aluminum powder blend is such that the resulting master composition contains, by weight, 45 parts of ferrophosphorus, 10 parts of silicon fines and 45 parts of aluminum powder. The mixture, after thorough mixing, is compacted at 9 tons per square inch to form discs about one-fourth in diameter and three-sixteenths inch in thickness. These discs are added to a molten hyper-eutectic silicon-aluminum casting alloy containing 17 percent by weight of silicon. The amount of master composition added is such as to introduce 0.01 percent by weight of phosphorus into the casting alloy and provides refinement of the silicon grains thereof, although not to the degree as in Example 2, below.

EXAMPLE 2

The 45/10/45 ferrophosphorus/silicon/aluminum master composition of Example 1 is compacted at 9 tons per square inch to form discs about one-fourth inch in diameter and three-sixteenths inch in thickness. The discs are added to a molten silicon-aluminum (17% Si) casting alloy in an amount which introduces 0.025 percent phosphorus and provide excellent refinement of the silicon grains thereof. Examination of the structure of the metal cast from this alloy shows that the primary silicon grains thereof are as effectively refined as by an equal amount of phosphorus added in the form of conventional phos-copper.

The foregoing description is intended to illustrate, without limitation, the product and process of the invention. It is understood, of course, that changes and variations can be made in the embodiments described herein without departing from the scope of the invention as defined in the following claims.

I claim:

1. A master composition for adding a primary silicon grain-refining amount of phosphorus to hyper-eutectic silicon-aluminum alloys, said composition comprising an intimate mixture of particles of ferrophosphorus and particles of aluminum metal.

2. A master composition according to claim 1 wherein:

the ferrophosphorus contains between about 20 and 30 weight percent phosphorus with the balance being made up essentially of iron; and the weight ratio of ferrophosphorus to aluminum in the master composition is between about 3:2 and 2:3.

3. A master composition according to claim 2 wherein:

the ferrophosphorus contains between about 23 and 28 weight percent phosphorus;

the weight ratio of ferrophosphorus to aluminum in the master composition is about 1:1, and the particles of ferrophosphorus and aluminum are about minus 100 mesh.

4. A master composition according to claim 3 wherein:

the intimate mixture of particles is compressed into shaped compacts of convenient size for addition to molten hyper-eutectic silicon-aluminum alloys; and the particles of ferrophosphorus and aluminum are about minus 325 mesh.

5. A master composition according to claim 1 containing additionally particles of silicon in an amount so as to compensate for the dilution of the silicon content of the hyper-eutectic silicon-aluminum casting alloy caused by the addition of the master composition.

6. A process for refining the primary silicon grains of hyper-eutectic silicon-aluminum alloys, said process comprising adding to said alloy in molten form, a grain-refining amount of a master composition comprising a compacted intimate mixture of particles of ferrophosphorus and particles of aluminum metal.

7. A process according to claim 6 wherein:

the ferrophosphorus contains between about 20 and 30 weight percent phosphorus with the balance being made up essentially of iron; and the weight ratio of ferrophosphorus to aluminum in the master composition is between about 3:2 and 2:3.

8. A process according to claim 7 wherein:

the ferrophosphorus contains between about 23 and 28 percent phosphorus;

the weight ratio of ferrophosphorus to aluminum in the master composition is about 1:1; and the particles of ferrophosphorus and aluminum are about minus 100 mesh.

9. A process according to claim 8 wherein:

the compacted intimate mixture of particles is in the form of shaped compacts of convenient size for addition to the molten alloy;

the particles of ferrophosphorus and aluminum are about minus 325 mesh and;

the master composition is added to the molten silicon-aluminum alloy in an amount which introduces at least about 0.01 weight percent of phosphorus into the alloy.

10. A process according to claim 9 wherein the master composition is added to the molten silicon-aluminum alloy in an mount which introduces about 0.025 weight percent of phosphorus into the alloy.

11. A process according to claim 6 wherein the compacted composition contains additionally particles of silicon in an amount so as to compensate for the dilution of the silicon content of the hyper-eutectic silicon-aluminum alloy caused by the addition of the master composition.

* * * * *